US009534513B2

(12) United States Patent
David et al.

(10) Patent No.: US 9,534,513 B2
(45) Date of Patent: Jan. 3, 2017

(54) CAMSHAFT PHASER ACTUATED BY AN ELECTRIC MOTOR

(71) Applicant: DELPHI TECHNOLOGIES, INC., Troy, MI (US)

(72) Inventors: Pascal David, Beidweiler (LU); Pierre Kimus, Attert (BE); Eric Bourniche, Lexy (LU)

(73) Assignee: Delphi Technologies, Inc., Troy, MI (US)

( * ) Notice: Subject to any disclaimer, the term of this patent is extended or adjusted under 35 U.S.C. 154(b) by 178 days.

(21) Appl. No.: 14/595,265

(22) Filed: Jan. 13, 2015

(65) Prior Publication Data

US 2015/0354415 A1 Dec. 10, 2015

Related U.S. Application Data

(60) Provisional application No. 61/928,049, filed on Jan. 16, 2014.

(51) Int. Cl.

| | |
|---|---|
| ***F01L 1/34*** | (2006.01) |
| ***F01L 1/344*** | (2006.01) |
| *F01L 1/352* | (2006.01) |

(52) U.S. Cl.

CPC ..... *F01L 1/344* (2013.01); *F01L 2001/3521* (2013.01); *F01L 2001/3522* (2013.01)

(58) Field of Classification Search

CPC ..... F01L 1/344; F01L 2001/3521; F01L 2001/3522

USPC ..... 123/90.15, 90.17

See application file for complete search history.

(56) References Cited

U.S. PATENT DOCUMENTS

| | | | | |
|---|---|---|---|---|
| 7,421,989 | B2 | 9/2008 | Fischer et al. | |
| 8,322,318 | B2 | 12/2012 | David et al. | |
| 8,516,983 | B2 | 8/2013 | David et al. | |
| 8,726,865 | B2 * | 5/2014 | David | F01L 1/352 123/90.15 |
| 2003/0226532 | A1 | 12/2003 | Takenaka et al. | |
| 2007/0163526 | A1 | 7/2007 | Sugiura et al. | |
| 2008/0047511 | A1 | 2/2008 | Taye et al. | |
| 2011/0030632 | A1 | 2/2011 | David et al. | |
| 2012/0312258 | A1 | 12/2012 | Kimus et al. | |

FOREIGN PATENT DOCUMENTS

| | | |
|---|---|---|
| JP | 08021214 A | 1/1996 |

* cited by examiner

*Primary Examiner* — Ching Chang
(74) *Attorney, Agent, or Firm* — Joshua M. Gaines

(57) ABSTRACT

A camshaft phaser is provided for controllably varying the phaser relationship between a crankshaft and a camshaft in an internal combustion engine which includes a camshaft bearing for supporting the camshaft and which defines a mounting bore for mounting the camshaft phaser to the internal combustion engine. The camshaft phaser includes a housing with a gear drive unit disposed within the housing. The gear drive unit includes an input gear member and an output gear member such that the input gear member is attachable to the crankshaft and such that the input gear member is attached to an output shaft of an electric motor. The output gear member is attachable to the camshaft such that rotation of the input gear member by the electric motor causes relative rotation between the crankshaft and the camshaft. The camshaft phaser is disposed between the mounting bore and the camshaft bearing.

18 Claims, 3 Drawing Sheets

CAMSHAFT PHASER ACTUATED BY AN ELECTRIC MOTOR

CROSS-REFERENCE TO RELATED PATENT APPLICATIONS

This patent application claims the benefit of U.S. provisional patent application Ser. No. 61/928,049 filed on Jan. 16, 2014, the disclosure of which is hereby incorporated by reference in its entirety.

TECHNICAL FIELD OF INVENTION

The present invention relates to camshaft phaser for changing the phase relationship between a camshaft and crankshaft of an internal combustion engine, more particularly to such a camshaft phaser which is actuated by an electric motor, and even more particularly to such a camshaft phaser which uses a harmonic gear drive unit actuated by the electric motor to vary the phase relationship between the crankshaft and the camshaft of the internal combustion engine.

BACKGROUND OF INVENTION

Camshaft phasers for varying the timing of combustion valves in internal combustion engines are well known. A first element, known generally as a sprocket element, is driven by a chain, belt, or gearing from the crankshaft of the internal combustion engine. A second element, known generally as a camshaft plate, is mounted to the end of a camshaft of the internal combustion engine. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, and consequently the angular position of the camshaft relative to the crankshaft, as required to meet current or anticipated engine operating conditions.

While vane-type camshaft phasers are effective and relatively inexpensive, they do suffer from drawbacks such as slow operation at low engine speeds due to low oil pressure, slow operation at low engine temperatures due to high oil viscosity, increased oil pump capacity requirement for the oil pump used to lubricate the internal combustion because the same pump is used to actuate the vane-type camshaft phaser, and the total amount of phase authority provided by vane-type camshaft phasers is limited by the amount of space between adjacent vanes and lobes and may not be sufficient to provide the desired amount of phase authority. For at least these reasons, the automotive industry is developing electrically driven camshaft phasers.

One type of electrically driven camshaft phaser being developed uses a harmonic gear drive unit, actuated by an electric motor, to change the angular position of the camshaft relative to the crankshaft. One example of such a camshaft phaser is shown in United States Patent Application Publication No. US 2012/0312258 A1 to Kimus et al. and U.S. Pat. No. 8,516,983 to David et al., the disclosures of which are both incorporated herein by reference in their entirety. While the camshaft phasers of Kimus et al. and David et al. may be effective, the disclosed camshaft phasers are mounted to the camshafts by bolting the camshaft phasers to the axial end of the camshafts. Some internal combustion engines utilize a camshaft with a timing sprocket secured thereto which is driven by a chain from the camshaft. The timing sprocket may be located axially between camshaft bearings which support the camshaft. The camshaft phasers of Kimus et al. and David et al. are not suitable for such a camshaft, timing sprocket, and camshaft bearing arrangement because bolting the camshaft phasers of Kimus et al. and David et al. to the axial end of the camshaft does not allow proper positioning of the camshaft phaser to connect to the chain to the corresponding sprocket of the camshaft phaser. Consequently, a significant redesign of the internal combustion engine would be necessary in order to mount the camshaft phasers of Kimus et al. and David et al. Such a redesign may be time consuming and costly to accomplish.

What is needed is a camshaft phaser which minimizes or eliminates one or more of the shortcomings as set forth above.

SUMMARY OF THE INVENTION

Briefly described, a camshaft phaser is provided for controllably varying the phaser relationship between a crankshaft and a camshaft in an internal combustion engine. The internal combustion engine includes a camshaft bearing for supporting the camshaft and the internal combustion engines defines a mounting bore for mounting the camshaft phaser to the internal combustion engine. The camshaft phaser includes a housing with a gear drive unit disposed within the housing. The gear drive unit includes an input gear member and an output gear member such that the input gear member is attachable to the crankshaft and such that the input gear member is attached to an output shaft of an electric motor. The output gear member is attachable to the camshaft such that rotation of the input gear member by the electric motor causes relative rotation between the crankshaft and the camshaft. The camshaft phaser is disposed between the mounting bore and the camshaft bearing.

BRIEF DESCRIPTION OF DRAWINGS

This invention will be further described with reference to the accompanying drawings in which.

DETAILED DESCRIPTION OF INVENTION

Figure 1:
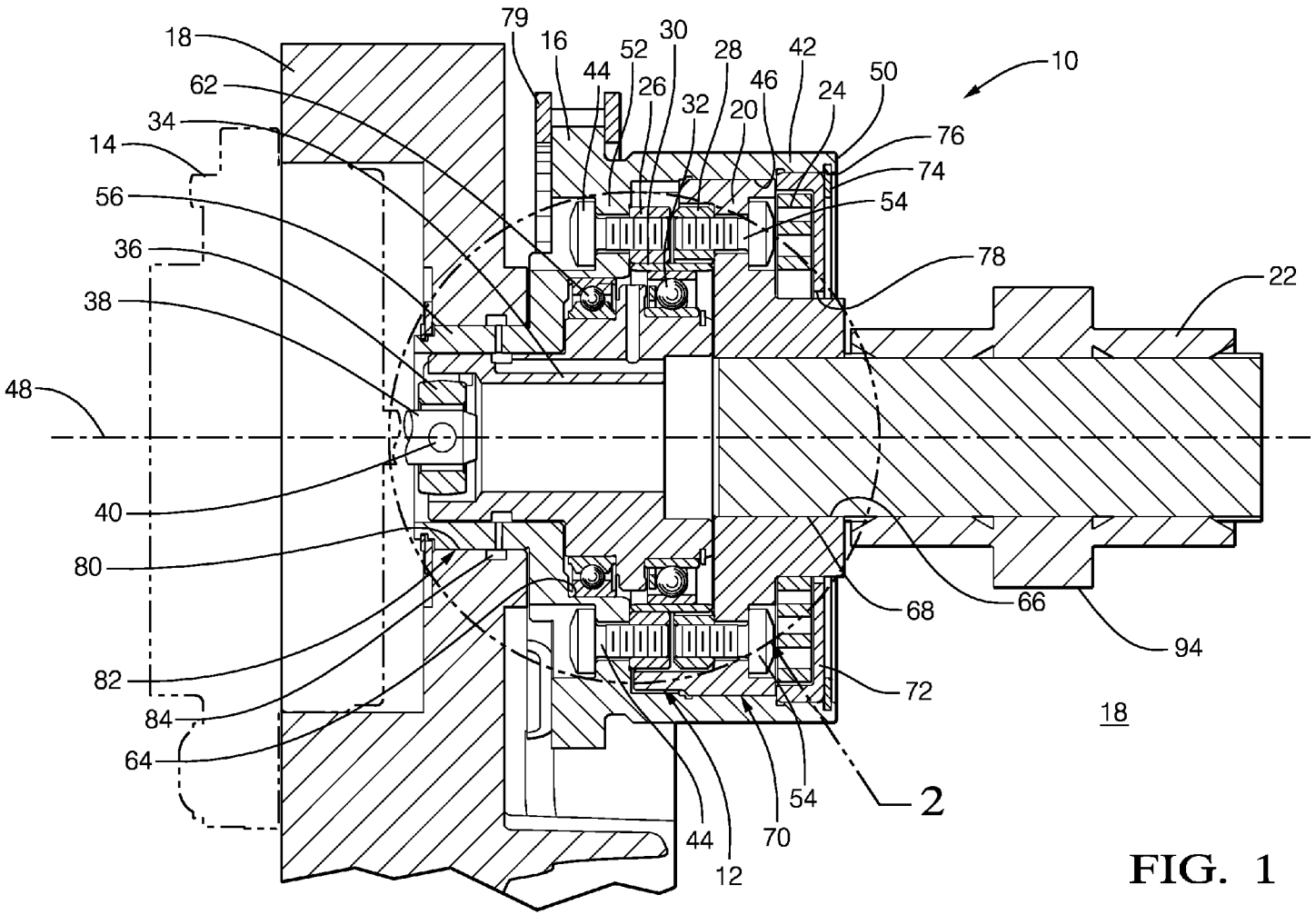
FIG. 1 is an axial cross-sectional view of a camshaft phaser in accordance with the present invention.
Figure 2:
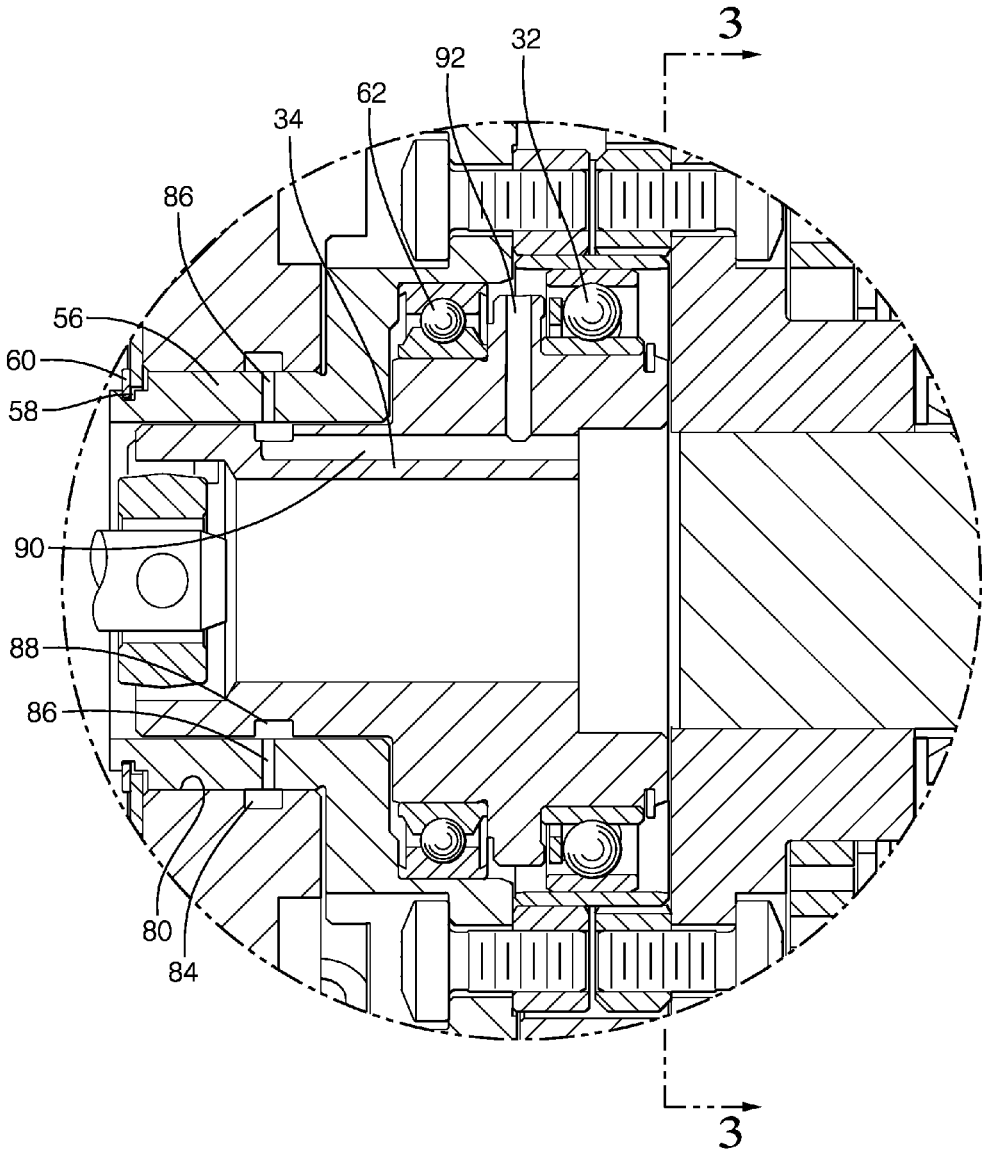
FIG. 2 is an enlarged view of a portion of FIG. 1.

Referring to FIGS. 1 and 2, a camshaft phaser 10 in accordance with the present invention comprises a harmonic gear drive unit 12; a rotational actuator illustrated as electric motor 14 which is operationally connected to harmonic gear drive unit 12 and which may be a DC electric motor; an input sprocket 16 operationally connected to harmonic gear drive unit 12 and drivable by a crankshaft (not shown) of an internal combustion engine 18; an output hub 20 attached to harmonic gear drive unit 12 and coupled to a camshaft 22 of internal combustion engine 18 to rotate with camshaft 22 in a one-to-one relationship; and a bias spring 24 operationally disposed between output hub 20 and input sprocket 16.

Harmonic gear drive unit 12 comprises an outer first spline 26 which may be either a circular spline or a dynamic spline as described below; an outer second spline 28 which is the opposite (dynamic or circular) of outer first spline 26 and is coaxially positioned adjacent outer first spline 26; a flexspline 30 disposed radially inward of both outer first spline 26 and outer second spline 28 and having outwardly-extending gear teeth disposed for engaging inwardly-extending gear teeth on both outer first spline 26 and outer second spline 28; and a wave generator 32 disposed radially inward of and engaging flexspline 30.

Flexspline 30 is a non-rigid ring with external teeth on a slightly smaller pitch diameter than the circular spline. Flexspline 30 is fitted over and elastically deflected by wave generator 32.

The circular spline (either outer first spline 26 or outer second spline 28) is a rigid ring with internal teeth engaging the teeth of flexspline 30 across the major axis of wave generator 32. The circular spline may serve as the input member.

The dynamic spline (whichever of outer first spline 26 and outer second spline 28 that is not the circular spline) is a rigid ring having internal teeth of the same number as flexspline 30. The dynamic spline rotates together with flexspline 30 and may serve as the output member. Either the dynamic spline or the circular spline may be identified by a chamfered corner at its outside diameter to distinguish the circular spline from the dynamic spline.

Wave generator 32 is an assembly of an elliptical steel disc supporting an elliptical bearing, the combination defining a wave generator plug. A flexible bearing retainer surrounds the elliptical bearing and engages flexspline 30. Rotation of the wave generator plug causes a rotational wave to be generated in flexspline 30 (actually two waves 180° apart, corresponding to opposite ends of the major ellipse axis of the disc).

During assembly of harmonic gear drive unit 12, the outwardly extending teeth of flexspline 30 engage the inwardly extending teeth of the circular spline and the dynamic spline along and near the major elliptical axis of wave generator 32. The dynamic spline has the same number of teeth as flexspline 30, so rotation of wave generator 32 causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator 32). Harmonic gear drive unit 12 is thus a high-ratio gear transmission; that is, the angular phase relationship between outer first spline 26 and outer second spline 28 changes by 2% for every revolution of wave generator 32.

Of course, as will be obvious to those skilled in the art, the circular spline rather may have slightly more teeth than the dynamic spline has, in which case the rotational relationships described are reversed.

Wave generator 32 includes a coupling adaptor 34 that is mounted thereto or formed integrally therewith. A coupling 36 is mounted to a motor shaft 38 of electric motor 14 and pinned thereto by a pin 40. Coupling 36 engages coupling adaptor 34, permitting wave generator 32 to be rotationally driven by electric motor 14, as may be desired to alter the phase relationship between outer first spline 26 and outer second spline 28.

Input sprocket 16 is rotationally fixed to a cup-shaped housing 42 that is fastened by bolts 44 to outer first spline 26 such that relative rotation between outer first spline 26 and housing 42 is prevented. As shown, input sprocket 16 is formed integrally with housing 42, however, it should now be understood that input sprocket 16 may be a separate component that is rotationally fixed to housing 42. Housing 42, which acts as an input member, includes a housing bore 46 extending into housing 42 along a longitudinal axis 48 upon which camshaft phaser 10 rotates. Housing bore 46 extends from a first open end 50 of housing 42 that is proximal to camshaft 22 to a housing base 52 which is substantially perpendicular to axis 48. Harmonic gear drive unit 12, output hub 20, and bias spring 24 are received coaxially within housing bore 46 where output hub 20 is fastened by bolts 54 to outer second spline 28 such that relative rotation between output hub 20 and outer second spline 28 is prevented. A mounting tube 56 extends axially away from housing base 52 in a coaxial relationship with housing bore 46 and defines a mounting tube annular groove 58 in an outside surface thereof for receiving a mounting tube snap ring 60 as will be described in greater detail later. A portion of coupling adaptor 34 is disposed within mounting tube 56 such that coupling adaptor 34 is allowed to freely rotate with respect to housing 42. Coupling adaptor 34 is supported within housing 42 by a bearing 62 which is received within a step 64 formed between housing bore 46 and mounting tube 56. Bearing 62 may be retained to housing 42 and coupling adaptor 34, for example, by press fit. While coupling adaptor 34 is shown to be made of unitary construction with wave generator 32, it should be understand that coupling adaptor 34 may be made separately and joined to wave generator 32 by known joining methods.

Figure 3:
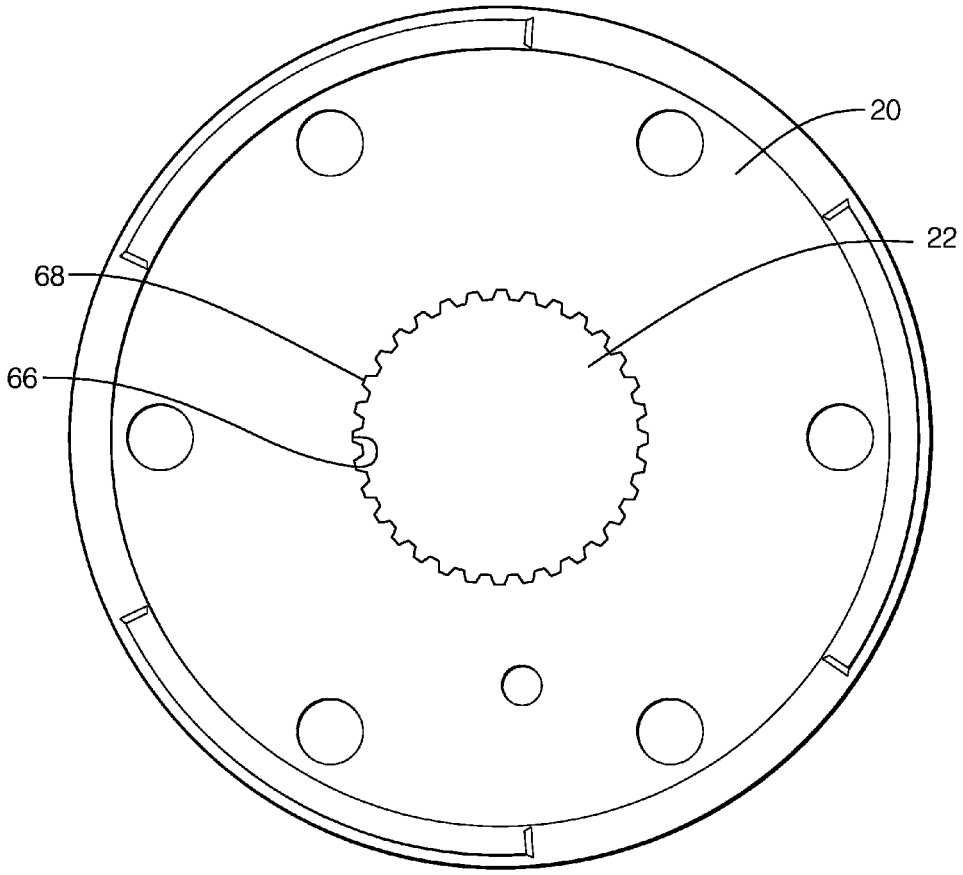
FIG. 3 is a cross-sectional view taken along section line 3-3 of FIG. 2.

With continued reference to FIGS. 1 and 2 and now with additional reference to FIG. 3, output hub 20, which acts as an output member for camshaft phaser 10, is rotationally coupled to camshaft 22 in order to prevent relative rotation between output hub 20 and camshaft 22. Consequently, relative rotation is also prevented between outer second spline 28 and camshaft 22. In order to rotationally couple output hub 20 to camshaft 22, output hub 20 may include internal splines 66 which mate with corresponding external splines 68 of camshaft 22. While internal splines 66 and external splines 68 have been illustrated to rotationally couple output hub 20 to camshaft 22, it should now be understood that other geometric arrangements may be used that are commonly employed to rotationally couple two bodies that need to rotate together. Radial run-out between housing 42 and output hub 20 is limited by a first journal bearing interface 70 between housing 42 (input hub) and output hub 20. Internal splines 66 and external splines 68 allow for variations in concentricity and angular misalignment between output hub 20 and camshaft 22 as may result from manufacturing variations.

Again with reference to FIGS. 1 and 2, output hub 20 is retained within housing 42 by being captured axially between harmonic gear drive unit 12 and a back plate 72 disposed within housing 42 and retained therein by a back plate snap ring 74 disposed in an annular back plate snap ring groove 76 formed in housing 42. Back plate 72 is prevented from rotating relative to housing 42, for example, by press fit. Back plate 72 includes a central back plate bore 78 extending axially therethrough to allow at least a portion of output hub 20 and/or camshaft 22 to extend through back plate 72.

Bias spring 24 is captured axially between back plate 72 and output hub 20. As shown, bias spring 24 may be a clock spring. One end of bias spring 24 is engaged with output hub 20 while the other end of bias spring 24 is engaged with back plate 72. In the event of a malfunction of electric motor 14, bias spring 24 is biased to back-drive harmonic gear drive unit 12 without help from electric motor 14 to a rotational position of outer second spline 28 wherein internal combustion engine 18 will start or run, which position may be at one of the extreme ends of the range of authority or intermediate of the camshaft phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for internal combustion engines requiring an intermediate park position for idle or restart.

Camshaft phaser 10 is mounted to internal combustion engine 18 via mounting tube 56 of housing 42 which is received coaxially within a mounting bore 80 of internal combustion engine 18. The portion of internal combustion engine 18 which defines mounting bore 80 may be a bracket which is bolted to the engine block and/or cylinder head of internal combustion engine 18. The outer circumference of mounting tube 56 forms a second journal bearing interface 82 with mounting bore 80. Second journal bearing interface 82 substantially prevents radial movement of mounting tube 56 within mounting bore 80 while allowing mounting tube 56 to rotate about axis 48 substantially uninhibited within mounting bore 80. The portion of internal combustion engine 18 which defines mounting bore 80 is captured axially between housing 42 and mounting tube snap ring 60, thereby retaining mounting tube 56 within mounting bore 80. In this way, camshaft phaser 10 is mounted and retained to internal combustion engine 18 and second journal bearing interface 82 carries the radial load generated by a chain 79 which engages input sprocket 16 and drives camshaft phaser 10.

In order to lubricate second journal bearing interface 82 and various elements and interfaces of camshaft phaser 10, mounting bore 80 includes an annular mounting bore oil groove 84. Annular mounting bore oil groove 84 is supplied with pressurized oil from an oil gallery (not shown), which may be supplied, for example only, from an oil pump of internal combustion engine 18. The pressurized oil supplied to annular mounting bore oil groove 84 infiltrates second journal bearing interface 82, thereby providing lubrication thereto. Annular mounting bore oil groove 84 is aligned and in fluid communication with one or more mounting tube oil passages 86 which extend radially through mounting tube 56. Mounting tube oil passages 86 are aligned and in fluid communication with a corresponding annular coupling adaptor oil groove 88 which is formed on the outer circumference of the portion of coupling adaptor 34 that is positioned within mounting tube 56. Annular coupling adaptor oil groove 88 is in fluid with an axial coupling adaptor oil passage 90 which extends axially from annular coupling adaptor oil groove 88 and exits facing toward output hub 20. A radial coupling adaptor oil passage 92 branches off of axial coupling adaptor oil passage 90 and extends radially outward therefrom between bearing 62 and wave generator 32. The oil exiting axial coupling adaptor oil passage 90 and radial coupling adaptor oil passage 92 lubricates one or more of at least wave generator 32, bearing 62, harmonic gear drive unit 12, and first journal bearing interface 70. The oil then drains out of camshaft phaser 10 through, for example only, drain passages (not shown) through back plate 72 in order to drain back to the oil pump of internal combustion engine 18.

In operation, when a change of phase is desired between the crankshaft of internal combustion engine 18 and camshaft 22, motor shaft 38 of electric motor 14 is rotated by applying an electric current to electric motor 14. It should be noted that motor shaft 38 may be rotated either clockwise or counterclockwise as determined by whether it is desired to advance or retard camshaft 22 relative to the crankshaft. Rotation of motor shaft 38 causes wave generator 32 to rotate which causes a rotational wave to be generated in flexspline 30, thereby causing outer first spline 26 to rotate relative to outer second spline 28. Since outer first spline 26 is fixed to housing 42 and outer second spline 28 is fixed to output hub 20, housing 42 also rotates relative to output hub 20, thereby changing the phase relationship between camshaft 22 and the crankshaft.

Camshaft 22 may be supported by a camshaft bearing 94. As shown, camshaft phaser 10 is located axially between camshaft bearing 94 and mounting bore 80. In this way, camshaft phaser 10 may be applied to internal combustion engine 18 which may have originally been designed to have camshaft 22 supported by camshaft bearing 94 and mounting bore 80 such that the load from chain 79 was supported by both camshaft bearing 94 and mounting bore 80. Consequently, camshaft phaser 10 may be applied to an internal combustion engine originally designed to not include a camshaft phaser and having a camshaft sprocket mounted between camshaft bearings.

The embodiment described herein describes harmonic gear drive unit 12 as comprising outer first spline 26 which serves as the input member; outer second spline 28 which serves as the output member and is coaxially positioned adjacent outer first spline 26; flexspline 30 disposed radially inward of both outer first spline 26 and outer second spline 28 and having outwardly-extending flexspline teeth for engaging inwardly-extending teeth of outer first spline 26 and outer second spline 28; and wave generator 32 disposed radially inward of and engaging flexspline 30. As described, harmonic gear drive unit 12 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inward of the circular spline and having outwardly-extending gear teeth disposed for engaging inwardly-extending gear teeth on the circular spline; and a wave generator disposed radially inward of and engaging the flexspline.

While the embodiment described herein has been described in terms of using a harmonic gear drive unit, it should now be understood that other gear drive units may be used within the scope of this invention. Some examples of other gear drive units may include, but are not limited to, spur gears, helical gears, hypoid gears, worm gears, and planetary gears. Generically, a motor shaft of an electric motor is attached to an input gear member of the gear drive unit through a coupling attached to the motor shaft and a coupling adapter attached to the input gear member. Rotation of the input gear member by the electric motor results in relative rotation between the input gear member and an output gear member of the gear drive unit which is connected to the camshaft of the engine. As a result, the camshaft is rotated relative to the crankshaft of the engine.

Camshaft phaser 10 may include stops which limit the amount of relative rotation permitted between housing 42 and output hub 20, thereby limiting the change in phase between the crankshaft and camshaft 22. One example of stops for limiting the amount of relative rotation between housing 42 and output hub 20 is disclosed in U.S. Pat. No. 8,322,318 to David et al., the disclosure of which is incorporated herein by reference in its entirety.

While this invention has been described in terms of preferred embodiments thereof, it is not intended to be so limited, but rather only to the extent set forth in the claims that follow.

We claim:

1. A camshaft phaser for controllably varying the phase relationship between a crankshaft and a camshaft in an internal combustion engine, said internal combustion engine having a camshaft bearing for supporting said camshaft, said internal combustion engine defining a mounting bore for mounting said camshaft phaser to said internal combustion engine, said camshaft phaser comprising:

a housing;

a gear drive unit disposed within said housing, said gear drive unit having an input gear member and an output gear member, the input gear member being attachable to said crankshaft and being attached to an output shaft of an electric motor, said output gear member being attachable to said camshaft such that rotation of said input gear member by said electric motor causes relative rotation between said crankshaft and said camshaft;

wherein said camshaft phaser is disposed between said mounting bore and said camshaft bearing.

2. A camshaft phaser as in claim 1 wherein said housing includes a mounting tube extending axially therefrom and into said mounting bore of said internal combustion engine such that said camshaft phaser is supported by said mounting bore and such that said mounting tube is able to freely rotate within said mounting bore.

3. A camshaft phaser as in claim 2 wherein said mounting tube and said mounting bore define a journal bearing interface.

4. A camshaft phaser as in claim 3 wherein said journal bearing interface is lubricated by oil from said internal combustion engine.

5. A camshaft phaser for controllably varying the phase relationship between a crankshaft and a camshaft in an internal combustion engine, said internal combustion engine having a camshaft bearing for supporting said camshaft, said internal combustion engine defining a mounting bore for mounting said camshaft phaser to said internal combustion engine, said camshaft phaser comprising:

a housing having a longitudinal axis;

a harmonic gear drive unit disposed within said housing, said harmonic gear drive unit comprising an outer first spline, an outer second spline which is axially adjacent to said outer first spline and disposed within said housing, a flexspline disposed radially within said outer first spline and said outer second spline, a wave generator disposed radially within said flexspline, and a rotational actuator connectable to said wave generator such that rotation of said rotational actuator causes relative rotation between said outer first spline and said outer second spline, wherein said outer first spline is fixed to said housing in order to prevent relative rotation therebetween; and an output hub rotatably disposed radially within said housing axially adjacent to said harmonic gear drive unit and rotationally coupleable to said camshaft and fixed to said outer second spline in order to prevent relative rotation therebetween;

wherein said camshaft phaser is disposed between said mounting bore and said camshaft bearing.

6. A camshaft phaser as in claim 5 wherein said housing includes a mounting tube extending axially therefrom and into said mounting bore of said internal combustion engine such that said camshaft phaser is supported by said mounting bore and such that said mounting tube is able to freely rotate within said mounting bore.

7. A camshaft phaser as in claim 6 wherein said mounting tube and said mounting bore define a journal bearing interface.

8. A camshaft phaser as in claim 7 wherein said journal bearing interface is lubricated by oil from said internal combustion engine.

9. A camshaft phaser as in claim 6 wherein said mounting tube includes a snap ring which retains said mounting tube within said mounting bore such that said mounting bore is captured axially between said snap ring and said housing.

10. A camshaft phaser as in claim 5 wherein:

said housing includes a housing bore extending from a first open end to a housing base that is perpendicular to said longitudinal axis; and a mounting tube extends axially from said housing base and into said mounting bore of said internal combustion engine such that said camshaft phaser is supported by said mounting bore and such that said mounting tube is able to freely rotate within said mounting bore.

11. A camshaft phaser as in claim 10 further comprising a coupling adaptor mounted to said wave generator such that said coupling adaptor engages said rotational actuator in order to transfer rotational motion from said rotational actuator to said wave generator, wherein said coupling adaptor extends into said mounting tube such that said coupling adaptor rotates freely within said mounting tube.

12. A camshaft phaser as in claim 11 wherein said mounting tube and said mounting bore define a journal bearing interface.

13. A camshaft phaser as in claim 12 wherein said journal bearing interface is lubricated by oil from said internal combustion engine.

14. A camshaft phaser as in claim 13 wherein:

said mounting tube includes a mounting tube oil passage;

said coupling adaptor includes a coupling adaptor oil passage in fluid communication with said mounting tube oil passage; and said mounting tube oil passage and said coupling adaptor oil passage provide an oil path which lubricates said harmonic gear drive unit.

15. A camshaft phaser as in claim 14 wherein said coupling adaptor includes a coupling adaptor oil groove on the outer circumference of said coupling adaptor such that said coupling adaptor oil groove provides fluid communication from said mounting tube oil passage to said coupling adaptor oil passage.

16. A camshaft phaser as in claim 14 wherein said mounting tube oil passage extends radially through said mounting tube.

17. A camshaft phaser as in claim 10 wherein said mounting tube includes a snap ring which retains said mounting tube within said mounting bore such that said mounting bore is captured axially between said snap ring and said housing.

18. A camshaft phaser as in claim 5 wherein said output hub includes internal splines which are mateable with corresponding external splines of said camshaft to rotationally couple said output hub to said camshaft.

* * * * *